United States Patent [19]

Focke et al.

[11] Patent Number: 4,790,333

[45] Date of Patent: Dec. 13, 1988

[54] APPARATUS FOR FEEDING CIGARETTES OR THE LIKE TO A PACKAGING MACHINE

[75] Inventors: Heinz Focke, Verden, Fed. Rep. of Germany; Henk G. Onderwaater, Holland, Netherlands

[73] Assignee: Focke & Co., Verden, Fed. Rep. of Germany

[21] Appl. No.: 519,480

[22] Filed: Aug. 1, 1983

[30] Foreign Application Priority Data

Aug. 4, 1982 [DE] Fed. Rep. of Germany ..... 3229092
Feb. 8, 1983 [DE] Fed. Rep. of Germany ..... 3304131

[51] Int. Cl.[4] ..... A24C 5/35

[52] U.S. Cl. ..... 131/283; 131/282; 198/347

[58] Field of Search ..... 131/282, 283; 198/347

[56] References Cited

U.S. PATENT DOCUMENTS 3,065,933 5/1972 Molins et al. ..... 131/283
3,596,797 8/1971 Wallenborn ..... 131/283
3,976,085 8/1976 Hall ..... 131/283
4,342,321 8/1982 Zullo ..... 131/283

*Primary Examiner*—V. Millin
*Attorney, Agent, or Firm*—Sughrue, Mion, Zinn, Macpeak and Seas

[57] ABSTRACT

A cigarette transfer apparatus is used for transporting the cigarettes to a packaging machine when the cigarettes are supplied periodically, especially in trestles (11), and this apparatus consists of an intermediate container (13) with several conveyors driven at increasing speed in the conveying direction, namely a receiving conveyor (22), an intermediate conveyor (24) and a discharge conveyor (23). A continuous cigarette stream (26) is formed within the intermediate container (13), and reductions (valley 39) in the cross-section of this cigarette stream as a result of an interrupted supply of cigarettes are compensated by a controlled drive of the conveyors, while ensuring continuous delivery to the packaging machine. The cigarette stream (26) is loaded at the top by a closely matching cigarette cover (40) consisting of individual rollers (41).

31 Claims, 7 Drawing Sheets

APPARATUS FOR FEEDING CIGARETTES OR THE LIKE TO A PACKAGING MACHINE

DESCRIPTION OF THE PRIOR ART

The invention relates to an apparatus for feeding cigarettes or the like to a packaging machine, the cigarettes being supplied in batches, especially in cigarette containers (trestles) which are overturned for emptying with an upper opening side downwards, in such a way that the cigarettes or the like run off from the cigarette container under their own weight to form a continuous cigarette stream consisting of cigarettes which are oriented parallel to one another and transversely to the direction of transport and which are fed by means of conveyors between lateral limitations (side walls) of the packaging machine.

The transfer of cigarettes from the production machine to the packaging machine always presents special problems arising within the flow of cigarettes between production and packaging. In practice, the cigarettes are mostly fed to the packaging machine in groups in special containers, so-called trestles. The problem is to guarantee uninterrupted continuous feeding to the packaging machine despite the fact that the cigarettes are supplied in batches.

In a known apparatus for feeding cigarettes extracted from a trestle to a packaging machine, the trestles are emptied, with an opening side directed downwards, over a conveyor belt which transfers a cigarette stream to a transfer conveyor leading to the packaging machine. Formed underneath the conveyor belt is a cigarette store which guarantees a continuous cigarette stream in the region of the transfer conveyor even when the cigarette supply is interrupted, particularly when an emptied trestle is changed. This apparatus has proved appropriate in practice. - EP-A-22 943 -.

The invention starts from the above mentioned or a similar apparatus for feeding cigarettes to a packaging machine or the like. The object on which the invention is based is to improve the flow of cigarettes and at the same time make the design of the apparatus simpler and less susceptible to faults.

SUMMARY OF THE INVENTION

To achieve this object, the apparatus according to the invention is characterised in that located above the cigarette stream, at least in a part region of the latter, is a cigarette cover which matches the (upper) contour of the cigarette stream.

The cigarette cover according to the invention can be designed in various ways and preferably consists of a chain of rotatable rollers arranged in a row next to one another. The cigarette cover comes to rest on the top side of the cigarette stream under its own weight, matching the ever-changing heights of the cigarette stream.

The cigarette cover guarantees that the cigarettes arranged above one another within the cigarette stream and oriented parallel to one another and transversely to the conveying direction maintain this relative position during transport. Furthermore, the transport of a relatively bulky cigarette stream is guaranteed because of the cigarette cover. As a result of the rotatable mounting of the rollers, the cigarettes are prevented from jumping over.

Moreover, the cigarette cover ensures that the lower cigarettes and therefore the entire cigarette stream are taken up by the conveyors carefully and in a fault-free manner. The cover also produces a continuous cigarette stream free of interruption because the cigarettes within the cigarette stream are gripped as a result of the slight pressure eperted by the cover.

For transporting the cigarettes or the cigarette stream, there are, according to the invention, several separately controllable conveyor belts or belt conveyors lying in a (horizontal) plane and succeeding one another, namely preferably a receiving conveyor, an intermediate conveyor and a discharge conveyor adjoining it. These are driven at different conveying speeds, which, in particular, increase in the conveying direction. An especially appropriate design is one in which a discharge conveyor facing the packaging machine is driven continuously, specifically preferably at a constant conveying speed. Within the framework of this solution, an intermediate conveyor located in front thereof is likewise driven continuously, but at different speeds, particularly at a reduced speed when the adjacent receiving conveyor is switched off momentarily because the cigarette supply is interrupted.

Further features of the invention relate to the arrangement of movement means or compensating bodies which are located within the cigarette stream, especially underneath the particular trestle which is emptied. These movement means are bodies with a special geometrical shape, particularly with conical or frustoconical shell surfaces. The relative arrangement is such that a converging position of the cigarettes, caused by the slight thickening of these in the region of a filter mouthpiece, is compensated. According to the invention, the movement means are driven to rotate, the axis of rotation being offset slightly in relation to the longitudinal centre axis, so that slight sideways movements are executed.

Exemplary embodiments of the invention are explained in more detail below with reference to the drawings,

DESCRIPTION OF PREFERRED EMBODIMENTS

The exemplary embodiment illustrated intentionally refers to the feeding of a packaging machine with cigarettes 10. These are supplied in relatively large batches in a special cigarette container, namely in a trestle 11.

Figure 1:
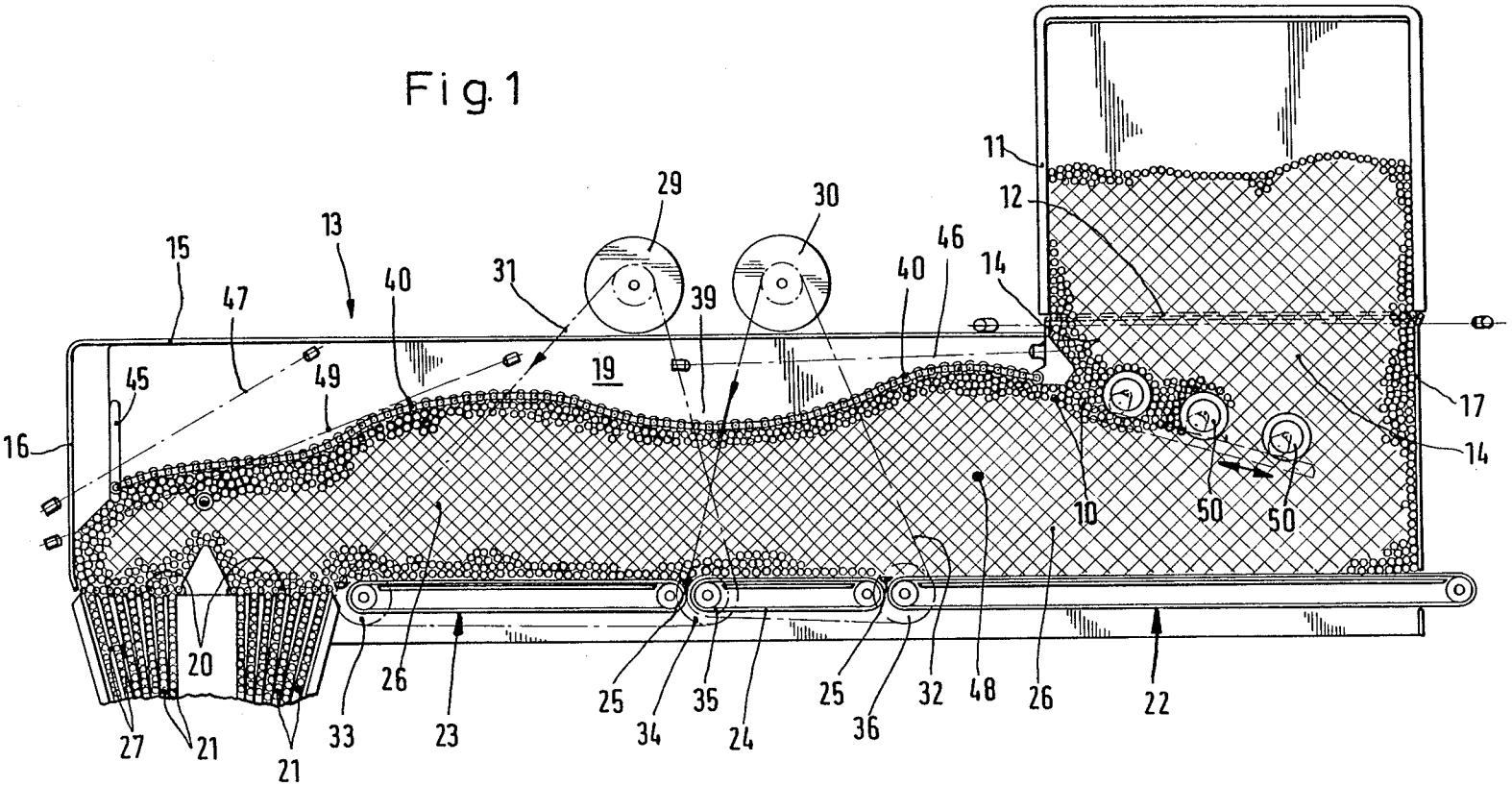
FIG. 1 shows an exemplary embodiment of the apparatus in a side view and longitudinal section.

The cigarettes 10 can be extracted from the trestle via open top 12 which initially points upwards. In the arrangement shown in FIG. 1, this is directed downwards, since the cigarettes 10 are extracted from the trestle 11 because the latter is overturned.

The trestle 11 is arranged, in this position, on an elongate, essentially rectangular intermediate container 13, overlying a feed orifice 14 of the latter. Moreover, the intermediate container 13 is limited by an upper wall 15, by end walls 16 and 17 extending at the ends, by side walls 18 and 19 and, at the bottom, by conveyors (belt bands). The upper wall 15 defines together with the adjacent end wall 17 the feed orifice 14. On the lower side of the intermediate container 13, located approximately diagonally opposite, the cigarettes are extracted from it, specifically in the region of an outflow orifice 20 formed in the lower plane of the intermediate container 13.

A particular feature of the present exemplary embodiment is that the intermediate container 13 performs the function of an otherwise conventional cigarette magazine. In accordance with a magazine of this type, there are formed in the region of the outflow orifice 20 essentially vertical cigarette shafts 21 which converge downwards in a conventional way and between which wedge-shaped shaft walls 27 are arranged. Cigarette groups assigned to a cigarette pack are extracted in a known way at the bottom end of these cigarette shafts 21. In the present exemplary embodiment, two groups of cigarette shafts 21 of this type are formed.

In the present case, the lower limitation or bottom of the intermediate container 13 is formed (outside the region of the outflow orifice 20) by three conveyors, namely a receiving conveyor 22, a discharge conveyor 23 and an intermediate conveyor 24 located between conveyors 22 and 23. The conveyors 22, 23 and 24 consisting endless of belt bands adjoin one another in a common (horizontal) plane. The receiving conveyor 22 extends to the end wall 17 and consequently underneath the feed orifice 14. The discharge conveyor 23, which is shorter in comparison with it, is directly adjacent to the outflow orifice 20. The intermediate conveyor 24, which is shorter than either of them, is located between the two. The transitions between the conveyors are formed by short bridges 25 fixed in place. The conveyors 22, 23 and 24 extend over the entire width of the intermediate container 13, that is to say at least from one side wall 18, 19 to the other.

The intermediate container 13 serves to hold the cigarettes after they have been extracted from the trestle 11, until they are transferred to the cigarette shafts 21 or to any further conveyor. However, the intermediate container 13 also performs the function of a store for the purpose of guaranteeing a constant uninterrupted feed of cigarettes when the supply of these trestles is discontinuous. During the time when an empty trestle 11 is exchanged for a full one, the transfer of cigarettes to the packaging machine should continue to take place. For this purpose, a sufficient cigarette stock is built up within the intermediate container 13, specifically by forming a continuous cigarette stream 26 extending from the feed orifice 14 to the outflow orifice 20. This cigarette stream is fed with a varying height to the outflow orifice 20 by the conveyors.

The conveyors 22, 23 and 24 are driven in a special manner and in different ways. During the emptying of a trestle 11 (FIG. 1), all the conveyors are driven, specifically at speeds with increase in the direction of transport. Accordingly, the receiving conveyor 22 revolves at the lowest speed, the intermediate conveyor 24 has a higher speed in comparison with this, and the discharge conveyor 23 revolves at the highest conveying speed. For conveying, for example, approximately 8,000 cigarettes per minute, belt speeds of 3.2 m/sec (discharge conveyor 23), 2.8 m/sec (intermediate conveyor 24) and 2 m/sec (receiving conveyor 22) are appropriate. The increasing belt speed makes it possible to convey away the entire quantity of cigarettes running off downwards from the trestle 11 with a deflection of 90° C. into the direction of the cigarette stream 26. The latter diminishes progressively in cross-section, particularly in height, so that the cigarette stream 26 is of relatively small height in the region of the run-in into the cigarette shaft 21.

During the time when the receiving conveyor 22 is stationary, that is to say when a trestle is changed, the discharge conveyor 23 continues to be driven at the same speed (for example, 3.2 m/sec). However, the intermediate conveyor 24 is driven at a reduced speed, for example at the same speed as the running receiving conveyor 22, thus, for example, 2 m/sec. The intermediate conveyor 24 above all performs the function of forming a transition stage in the transport path of the cigarettes. It is possible, as a result, to transfer the cigarettes with care from the relatively low conveying speed of the receiving conveyor 22 to the conveying speed of the discharge conveyor 23 which is relatively high in comparison with it. During the time when the receiving conveyor 22 is stationary, the transition is likewise made by the intermediate conveyor 24 running at a lower speed.

Figure 3:
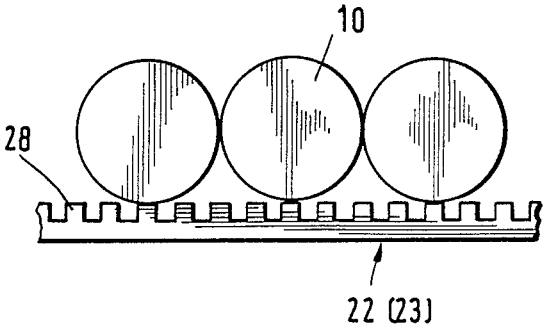
FIG. 3 shows a detail of the conveyors in a longitudinal section on an even larger scale.
Figure 4:
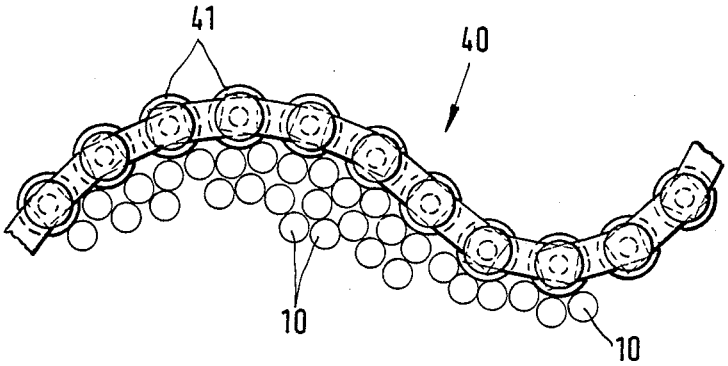
FIG. 4 shows, in a side view, a further detail, namely a cigarette cover.
Figure 5:
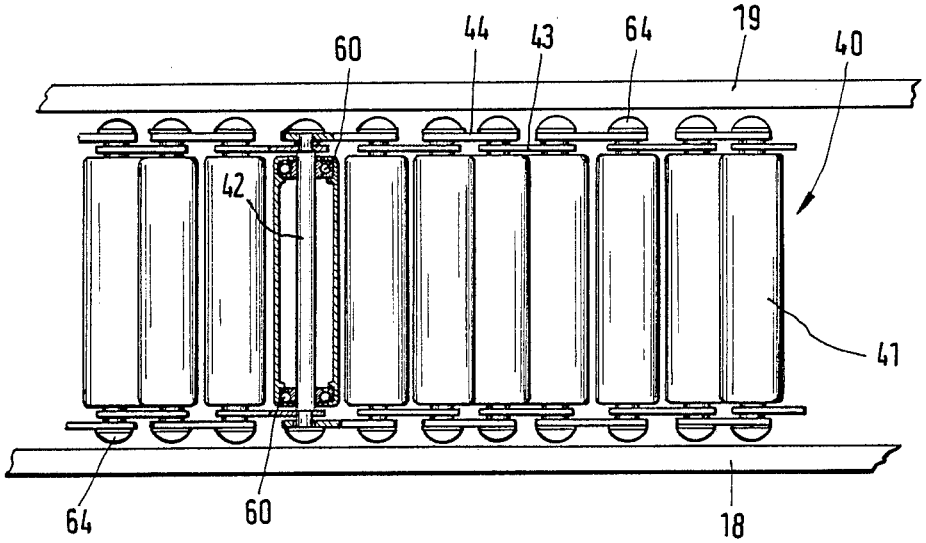
FIG. 5 is a plan view of the cigarette cover of FIG. 4, partially cut away to show the make-up of one of the rollers articulated to other rollers.

Because of their different functions, the conveyors or their conveyor belts have different designs. The receiving conveyor 22 and the discharge conveyor 23 are preferably designed along the lines of FIG. 3 with a surface shaping which improves the transporting effect, for example with sawtooth-like ribs 28 directed transversely. In contrast to this, the surface of the intermediate conveyor 24 is appropriately made smooth.

In the present exemplary embodiment, the (three) conveyors are driven by two drive motors 29 and 30. In the present case, these are mounted above the intermediate container 13, particularly above the upper wall 15. Driving wheels 33, 34, 35 and 36 in the region of deflection of the conveyors are driven via drive chains 31 and 32 respectively.

The drive motor 29 is assigned on the one hand to the driving wheel 33 for the discharge conveyor 23 and also to a driving wheel 34 of the intermediate conveyor. The drive motor 30 is connected to the driving wheel 36 of the receiving conveyor 22 and moreover to a further driving wheel 35 of the intermediate conveyor 24. The driving wheels 34 and 35 of the intermediate conveyor 24 are mounted on a common drive shaft 37 of the intermediate conveyor 24. The connection between the driving wheels 34 and 35, on the one hand, and the drive shaft 37, on the other hand, is such that one or the other drive motor 29, 30 for the intermediate conveyor 24 takes effect alternately. The drive motor 29 for the discharge conveyor 23 is driven continuously, apart from exceptional interruptions. As a result, the discharge conveyor 23 is likewise driven continuously. A driving force is transmitted likewise continuously to the intermediate conveyor 24 by means of the drive motor 29 via the driving wheel 34 which is of appropriate dimensions and is assigned to the drive motor 29, but at the lower speed. Accordingly, this comes into effect when the drive motor 30 is stopped. The intermediate conveyor 24 is now driven by the drive motor 29 at the reduced speed.

When the drive motor 30 is started, on the one hand the receiving conveyor 22 is driven, and moreover also the intermediate conveyor 24, at the higher speed as a result of the appropriate dimensions of the driving wheel 35 assigned to the drive motor 30. The drive via the driving wheel 34 is now ineffective, so that the intermediate conveyor 24 revolves at the higher speed. In the present exemplary embodiment, these alternations of speed are possible because the driving wheels 34 and 35 are connected to one another by an overrunning clutch 38. This can be designed in a known way and so that the faster drive movement (the drive motor 30 via the driving wheel 35) takes effect, the driving wheel 34 which continues to rotate being "overtaken".

The drive motor 30 is switched off momentarily for the change of trestles in the way described. The above-described coupling of the intermediate conveyor 24 to the drive of the receiving conveyor 22 and the discharge conveyor 23 ensures that the intermediate conveyor always has the best possible speed for conveying the cigarettes.

The above-described transport mechanism for the cigarette stream 26 effects continuous feeding of the packaging machine by supplying sufficient quantities of cigarettes in the region of the outflow orifice 20. Periodic interruption of the cigarette supply results in a reduction in cross-section, travelling in the conveying direction, of the cigarette stream, namely a valley 39. However, the "depth" of this is lessened considerably because of the effect of the intermediate conveyor 24 above all, so that a substantially uniform cigarette stream 26, particularly with slight heigh variations, but with an intentionally decreasing height, is produced.

The conveyors are especially effective when a cigarette cover 40 is arranged on the top of the cigarette stream 26. On the one hand, the purpose of this is to maintain the proper orientation of the cigarettes 10 transversely to the conveying direction and parallel to one another during transport and the relative movements caused thereby. On the other hand, the cigarette cover 40 effects proper transport as a result of its own weight which is slight and finely proportioned and with which it rests on the cigarette stream 26, without damaging the cigarettes. The cigarette cover 40 can match the contours of the cigarette stream 26 closely.

For this purpose, in the present exemplary embodiment the cigarette cover 40 consists of a number of rollers 41 connected pivotably or in an articulated manner to one another. These are likewise arranged transversely to the direction of transport, particularly axis-parallel to the cigarettes 10. Each roller 41 is rotatable about its own longitudinal axis, thus assisting the transport of the cigarettes 10.

Figure 6:
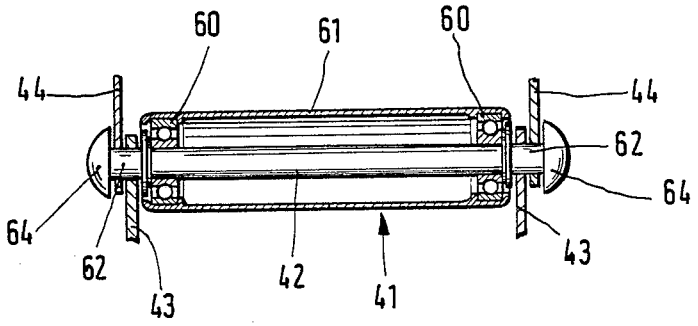
FIG. 6 shows, in a longitudinal section, a roller of the cigarette cover.

In the exemplary embodiment according to FIG. 6, the rollers 41 are equipped with ball bearings 60. The cylindrical roller casing 61, preferably consisting of plastic, is mounted rotatably via these on a continuous pin-like roller axle 42. The latter emerges from the roller casing 41 at the ends and the ends are capped at 64. In the region of a projecting length 62 located at both ends, connecting plates or links 43 and 44 are connected to the adjacent rollers on both sides. The connecting plates 43 and 44 are mounted rotatably or pivotably on the roller axles 42, so that a link chain with high movability is obtained.

Figure 7:
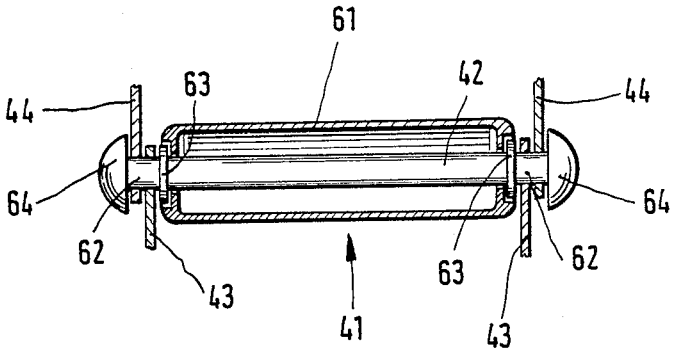
FIG. 7 shows a representation corresponding to FIG. 6 for another exemplary embodiment of the rollers.

In the exemplary embodiment according to Figure 7, the roller casing 61 of the roller 41 is mounted rotatably so as to slide about collars 63 on the roller axle 42.

The dimensions of the cigarette cover 27 designed in this way also match those of the cigarettes 10. The distance between the roller casings 61 is approximately 2 mm. The diameter of the rollers or of the roller casings is set at approximately 16 mm. A centre-to-centre distance of 18 mm is therefore obtained, all this allowing for a diameter of the cigarettes of 8 mm.

The dimensions mentioned above ensure that the cigarettes 10 do not penetrate into a gap between adjacent rollers 41 and become wedged here. On the contrary, during the relative movement, the cigarettes are moved past the rollers 41 while the latter rotate. At the same time, a certain slight braking effect is exerted on the cigarette stream 26. Furthermore, the bearing pressure generated by the cigarette cover 27 on the cigarette stream 26 is selected so that the cigarettes are taken up by the conveyors with a slight slip. The pressing function is the essential purpose of the cigarette cover. It therefore extends substantially over the entire conveying distance of the cigarettes, that is to say over the length of the feed stream 26. Over their entire length, the rollers 41 match the width of the intermediate container 13 in a longitudinal direction, so that the cigarette cover 40 can fit, with a slight gap, between the side walls 18 and 19. At the same time, rounded heads 64 can rest against the side walls 18, 19. The cigarettes 10 have approximately the same length and are therefore conveyed along the side walls 18, 19 likewise with a slight distance between these walls and their ends.

The cigarette cover 40 is anchored to the edge of the feed orifice 14, on the one hand, and above the outflow orifice 20, particularly to the side wall 19. The latter anchoring can be moved up and down in a guide rail 45. Accordingly, the cigarette cover 40 extends over approximately the entire length and width of the cigarette stream 26.

The height of the cigarette level within the intermediate container 13 is monitored constantly, specifically, on the one hand in the region of the cigarette feed and, on the other hand, in the region of the transfer to the packaging machine. For this purpose, two light barriers 47, 49 extending transversely to the longitudinal direction of the cigarettes 10 are located above the outflow orifice 20. The upper light barrier 47 monitors the maximum level of cigarettes 10 in the intermediate container 13 and causes the discharge conveyor 23 (or one of the conveyors located in front of it) to stop as soon as the cigarette stream 26 rises up to the light barrier 47. The minimum level is monitored by the light barrier 49 which acts on the packaging machine, located after the cigarette shaft 21 and not shown in the Figures, in such a way that this is stopped as soon as the stock of cigarettes 10 becomes too small. Following the feed orifice 14, a further light barrier 46 is formed above a part region of the conveying distance transversely to the longitudinal direction of the cigarettes 10, to monitor the maximum height of the cigarette stream 26 in this region. To correspond to this, a second transversely directed light barrier 48 (acting in the longitudinal direction of the cigarettes) extends underneath the light barrier 46. This serves for monitoring a minimum permissible level of cigarettes in the cigarette stream 26.

The light barrier 46 acts on the drive motor 30 to stop the latter so that the further supply of cigarettes is interrupted. On the other hand, the light barrier 48 is assigned to the drive motor 29, specifically likewise for the purpose of stopping it.

Figure 8:
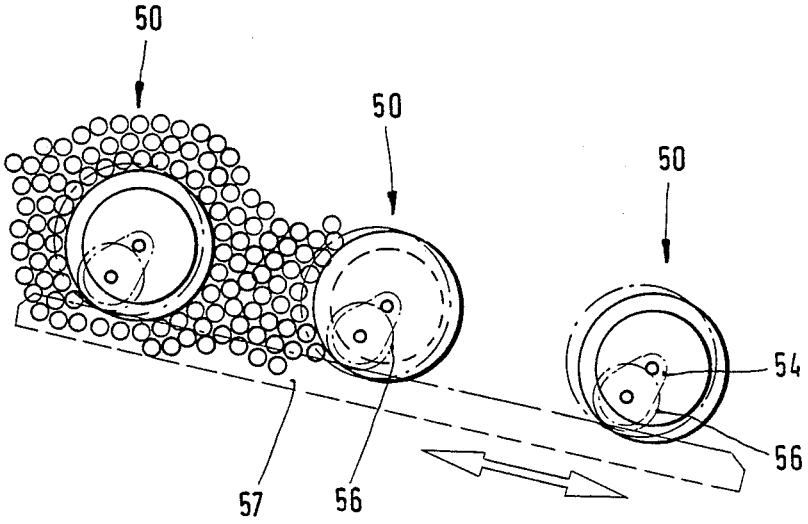
FIG. 8 shows, in a side view, a further detail of the apparatus, namely movement means.
Figure 9:
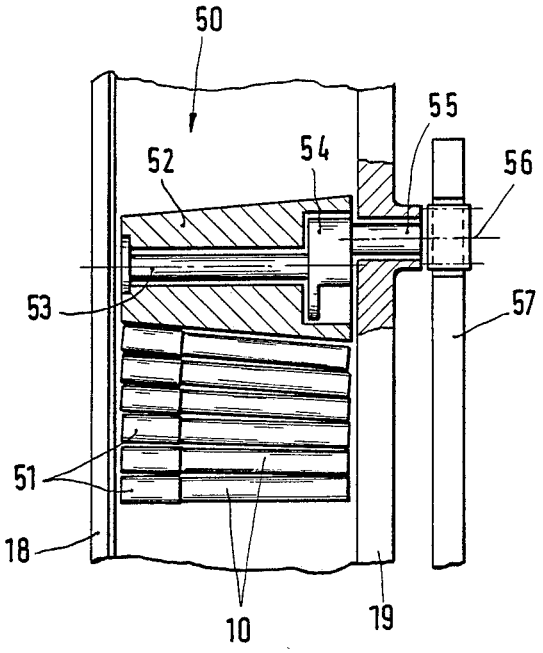
FIG. 9 shows a movement means according to FIG. 6 in a longitudinal section.

Located in the cigarette stream 26, that is to say within the intermediate container 13, are movement means 50, FIGS. 8, 9, which extend transversely to the conveying direction, that is to say approximately parallel to the cigarettes 10. In the present exemplary embodiment, three movement means 50 of this type are arranged, offset relative to one another in terms of height, in the region underneath the feed orifice 14, that is to say underneath the trestle 11. The cigarettes flow around the movement means 50, and the purpose of these is to align the cigarettes and prevent incorrect positioning within the cigarette stream as a result of a loosening effect.

A special feature is that the movement means 50 are designed with a conical or converging (frustoconical) shell surface, specifically directed opposite the slightly fanned-out position of the cigarettes. This converging relative position of the cigarettes 10 arises because of the larger diameter in the region of a filter 51 caused by the covering sheet resting on the outside. The movement means counteract this intrinsically undesirable relative position of the cigarettes 10 by compensating it as a result of their frustoconical shape. Further movement means of this type can be provided distributed within the cigarette stream.

In the present exemplary embodiment, a conical body of revolution 52 is mounted so as to be freely rotatable on a supporting journal 53. The latter is driven to move to and fro, specifically to rotate and to move in a transverse direction. For this purpose, a cam 54 is located on one end of the supporting journal 53. An eccentric drive shaft 55 is provided, outside the intermediate container 13, with a pinion 56. Pinion 56 is driven appropriately by a rack 57 moved to and fro. A common rack is provided for the three movement means of the exemplary embodiment illustrated. Accordingly, this ensures that the movement means are moved slightly to and fro transversely to the cigarettes, and the bodies of revolution 52 can be rotated by the cigarettes.

In the exemplary embodiment illustrated, special dimensions of the conveyors are predetermined as being the best possible. The receiving conveyor 22 has a length which is greater than the transverse dimension of the trestle 11, in particular 1.5 times the width of the latter. In contrast to this, the adjoining intermediate conveyor 24 is made considerably shorter, in particularly approximately 0.5 times the width of the trestle. The length of the discharge conveyor 23 depends on the local conditions governing the packaging machine, so that the cigarettes can be fed to this in the proper way.

Figure 2:
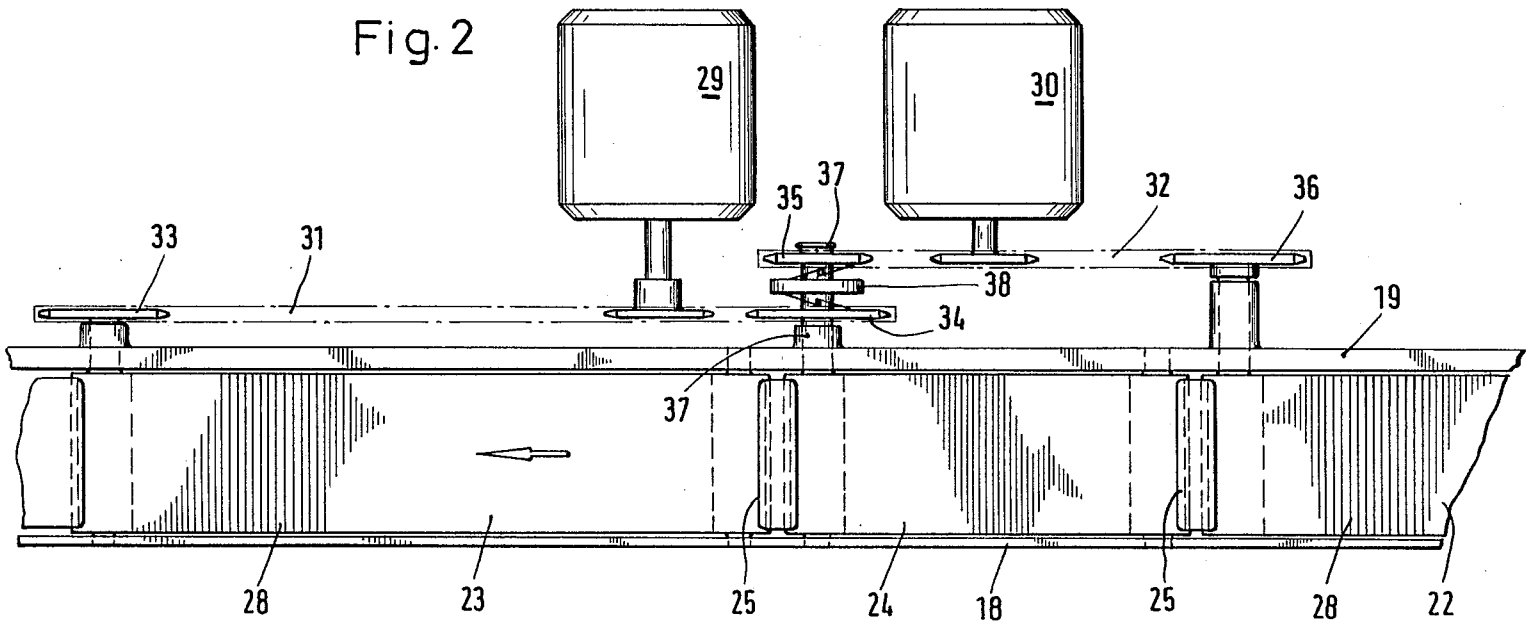
FIG. 2 shows a plan, on an enlarged scale, of a detail of the apparatus, namely conveyors belonging to it.

As is evident especially in FIG. 2, the pivot axles of the conveyor belts are mounted in the side walls 18 and 19 of the intermediate container 13.

We claim:

1. In an apparatus for feeding cigarettes or the like to a packaging machine comprising an intermediate container including laterally spaced vertical walls, an upper opening within said intermediate container for receiving cigarettes under their own weight to form a continuous cigarette stream with the cigarettes oriented parallel to one another and transversely of the intermediate container between said opposed walls, conveyors underlying said cigarette stream and forming the bottom of said intermediate container for transporting the cigarettes longitudinally of said intermediate container with the cigarettes at right angles to the direction of movement, the improvement comprising a cigarette cover (40) overlying and in contact with the top of said cigarette stream, said cover comprising a plurality of rigid members, and means for articulately connecting said rigid members together such that said cigarette cover matches the upper contours of the cigarette stream (26).

2. Apparatus according to claim 1, wherein said cigarette cover (40) rigid members constitute elongated members which extend essentially parallel to the longitudinal axis of the cigarettes (10) forming said cigarette stream.

3. Apparatus according to claim 1 or 2, further comprising means for mounting said rigid members of said cigarette cover (40) for rotation about axes parallel to the longitudinal axis of the cigarettes (10).

4. Apparatus according to claim 1, wherein said cigarette cover (40) rigid members comprise a plurality of rollers (41), means for mounting said rollers for rotation about their axes, with the axis of rotation of each roller being directed parallel to the longitudinal axis of the cigarettes within said cigarette stream and links at the end of said rollers for movably connecting adjacent rollers to each other at opposite ends thereof.

5. Apparatus according to claim 4, wherein said rotatable rollers (41) are cylindrical and are of a length approximately equal that of said cigarettes (10).

6. Apparatus according to claim 4, wherein said means for mounting said rollers (41) for rotation about their axes comprises continuous pin-like roller axles (42), and wherein said links comprise pivotable connecting plates (43, 44) extending outside of the rollers.

7. Apparatus according to claim 6, further comprising rounded heads (66) attached to the ends of the roller axles (42) which project beyond the ends of the rollers (41).

8. Apparatus according to claim 4, wherein the length of said links and the diameter of the rollers (41) are such that said rollers are maintained with a distance of approximately 2 mm between the peripheries of adjacent rollers.

9. Apparatus according to claim 4 wherein said rollers (41) have a diameter which is approximately double the diameter of a cigarette (10).

10. Apparatus according to claim 1 wherein said intermediate container comprises a feed orifice constituting an opening at the top of said intermediate container (13) at one end thereof, and wherein said cigarette cover is mounted at one end to said intermediate container (13), adjacent the edge of said feed orifice and extends to the opposite end wall of the intermediate container (13) from that aligned with a further edge of said feed orifice.

11. Apparatus according to claim 1 wherein said intermediate container (13) comprises a vertical guide slot (45) of the intermediate container (13) remote from said feed orifice, and wherein said cigarette cover includes means for fixably adjusting that end of said cigarette cover within said vertical guide slot.

12. In an apparatus for transporting cigarettes or the like to a packaging machine comprising:

an intermediate container containing including laterally opposed sidewalls, longitudinally opposed end walls, said intermediate container being upwardly open at one end such that cigarettes fall by gravity from an upturned cigarette container when emptied into the opening within the top of said intermediate container at that end such that said cigarettes fall under gravity to form a continuous cigarette stream consisting of cigarettes which are oriented parallel to one another and transversely to the longitudinal axis of said intermediate container and to the direction of transport, and said intermediate container further comprises at least one conveyor forming the bottom of said intermediate container, and underlying the continuous cigarette stream and moving parallel to the intermediate container sidewall such that the direction of transport of the cigarettes is away from the end of the intermediate container bearing the opening at the top thereof, the improvement comprising a first conveyor located beneath the opening within the top of the intermediate container and underneath the cigarette receptacle, means for stopping said first conveyor during interruption of cigarette supply and a change of cigarette receptacles, and wherein said at least one conveyor comprises several separately controllable conveyors adjoining one another, and downstream of said first conveyor in the direction of a packing machine at the opposite end of said intermediate container from said opening for receiving cigarettes from overturned cigarette containers positioned thereof.

13. Apparatus according to claim 12, wherein said intermediate conveyor comprises an outflow orifice formed in the bottom of said intermediate container diagonally opposite to the opening within the top of said intermediate container functioning as a feed orifice (14) for said cigarettes, and wherein said several separately controllable conveyors and said first conveyor extend from said end wall proximate to said feed orifice to said outflow orifice.

14. Apparatus according to claim 13, further comprising cigarette shafts (21) extending downwardly from the bottom of said intermediate container, within said outflow orifice (20) for directing cigarettes serially within said cigarette shafts from said continuous cigarette stream.

15. Apparatus according to claim 12, wherein said first conveyor comprises a receiving conveyor (22) formed by a first endless conveyor belt extending underneath the feed orifice (14) of the intermediate container (13), and said separably controllable conveyors comprise at least one second endless conveyor belt positioned adjacent to said first conveyor belt and extending parallel thereto in the direction of the outflow orifice (20), for further transporting the cigarette stream (26).

16. Apparatus according to claim 15, further comprising means for selectively terminating operation of the receiving conveyor (22) as a function of the degree of filling of the intermediate container of cigarettes from said cigarette container upturned at said feed orifice when the level of said cigarette stream falls below a specific height.

17. Apparatus according to claim 15, further comprising at least one independently controllable intermediate conveyor (24) located between the receiving conveyor (22) and the discharge conveyor (23).

18. Apparatus according to claim 12, further comprising means for driving said conveyors (22, 23, 24) at different speeds which increase in the direction of transport of said cigarettes from said feed orifice in the direction of said outflow orifice.

19. Apparatus according to claim 18 wherein said means for driving said conveyors at different speeds comprises means for driving said receiving conveyor (22) at a speed of approximately 2 m/sec, the intermediate conveyor (24) at approximately 2.8 m/sec and the discharge conveyor (23) at approximately 3.2 m/sec.

20. Apparatus according to claim 15, further comprising means for driving said discharge conveyor (23) continuously at a constant speed.

21. Apparatus according to claim 17, further comprising means for driving said intermediate conveyor (24) at a reduced speed when the cigarette supply is interrupted by change of cigarette container.

22. Apparatus according to claim 17, further comprising means for driving said conveyors by two drive motors (29, 30) operating at essentially constant different drive speeds, and wherein said apparatus further comprising a step-up/step-down gear system for selectively driving said conveyors at said different speeds from said two drive motors.

23. Apparatus according to claim 22, wherein said step-up/step-down gear system comprises means for driving said intermediate conveyor (24) alternately by one or the other of said drive motors (29, 30) at correspondingly different drive speeds.

24. Apparatus according to claim 22 further comprising means for selectively terminating drive motor (30) operation for said receiving conveyor (22) and for driving the drive motor operatively connected to the discharge conveyor (23) continuously.

25. Apparatus according to claim 22, further comprising an overrun clutch for effecting alternate driving of said intermediate conveyor (24) by one or the other of said drive motors (29, 30).

26. Apparatus according to claim 15, wherein said endless conveyor belts of at least one of said receiving conveyor (22) and said discharge conveyor (23) include ribs (28) for assisting in the take-up and movement of the cigarettes by said endless conveyor belts.

27. Apparatus according to claim 12 further comprising light barriers (48 and 49) directed transversely to the axis of the cigarettes for sensing the maximum and minimum height of the cigarette stream in the region of said cigarette movement through said outflow orifice.

28. Apparatus according to claim 12, further comprising a first light barrier for sensing the maximum height of the cigarette stream in the region of said feed orifice, which light barrier (46) is directed transversely to the cigarettes within the stream, and a second light barrier (48) in said region for sensing the minimum height of said cigarette stream, said second light barrier (48) being directed parallel to the cigarettes within said stream.

29. Apparatus according to claim 12, further comprising frustoconical shaped movement means (50) mounted within the cigarette stream (26), underneath the feed orifice (14), whose axis is parallel to the cigarettes, to assist in orienting the cigarettes during passage within said stream in a manner so as to compensate for the convergence of the cigarettes as a result of the larger diameter of the cigarettes in the region of the filter (51) thereof.

30. Apparatus according to claim 28 further comprising means for driving said movement means (50) to and fro transversely to the cigarettes in a small range of movement, and wherein said means includes drive means located outside of the intermediate container (13) and consisting of a rack (57) which moves to and fro and which engages an eccentrically arranged pinion (56) mechanically coupled to each movement means (50).

31. Apparatus according to claim 29, wherein said movement means (50) comprises a freely rotatable frustoconical body of revolution.

* * * * *